United States Patent [19]

Cann

[11] Patent Number: 4,957,060

[45] Date of Patent: Sep. 18, 1990

[54] ELECTROSTATIC SPRAY COATING SYSTEM

[75] Inventor: Roger Cann, Mt. Clemens, Mich.

[73] Assignee: Behr Industrial Equipment Inc., Rochester, Mich.

[21] Appl. No.: 284,125

[22] Filed: Dec. 14, 1988

[51] Int. Cl.[5] ..... B05B 5/08; B05B 15/12

[52] U.S. Cl. ..... 118/699; 118/326; 118/629

[58] Field of Search ..... 118/300, 326, 629, 698, 118/699, 703

[56] References Cited

U.S. PATENT DOCUMENTS 4,278,046 7/1981 Clarke et al. ..... 118/695
4,335,419 6/1982 Hastings ..... 55/107

OTHER PUBLICATIONS

Ernst, Greg, "Intrinsic Safety-An Alternative to Explosion-Proof", *Measurements & Control*, Apr., 1987, pp. 148-151.

Binks Manufacturing Technical Bulletin; "Electrostatic Spraying", TD 17-1R-3, Apr., 1988, pp. 1-8.

*Primary Examiner*—James C. Housel

*Attorney, Agent, or Firm*—Reising, Ethington, Barnard, Perry & Milton

[57] ABSTRACT

A spray coating apparatus (10) for applying flammable liquid coating material onto a work part (12), including an enclosed spray booth (14) for containing the sprayed flammable coating material in an isolated zone, an atomizer (18) positioned in the spray booth (14) for spraying the coating material onto the work part (12), and a color changer (28) disposed in the spray booth (14) and operated by pneumatic valves (24) for selecting the color of coating material to be supplied to the atomizer (18). Compressed air is supplied from a source outside the spray booth (14) to each of the pneumatic valves (24) on the color changer (28). Intrinsically safe electric solenoid valves (38) are disposed in the spray booth (14) for controlling the compressed air sent to particular pneumatic valves (24) at the color changer (28) so that the proper color of coating material is quickly fed to the atomizer and so that the apparatus (10) can be quickly assembled at locations remote from the place of manufacture.

17 Claims, 3 Drawing Sheets

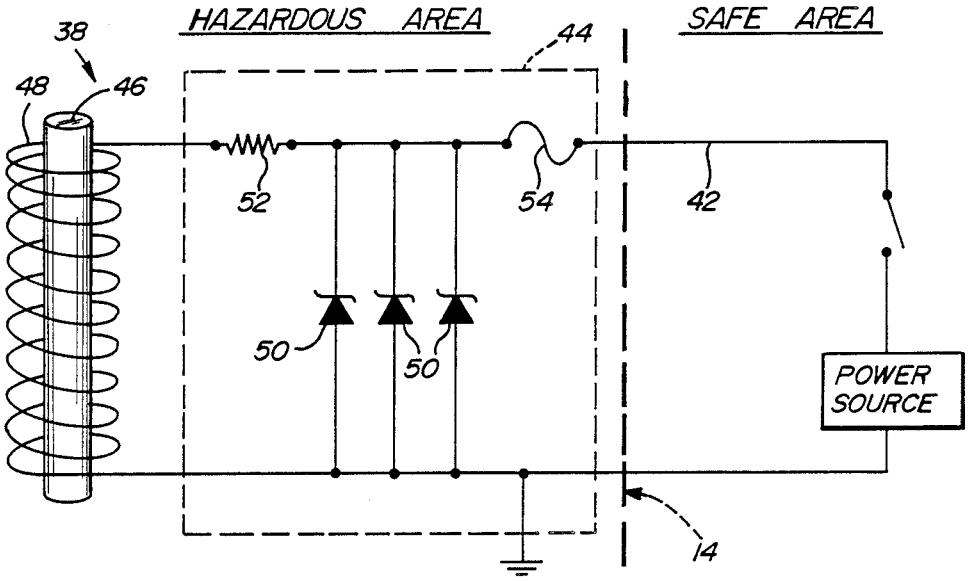
FIG. 3
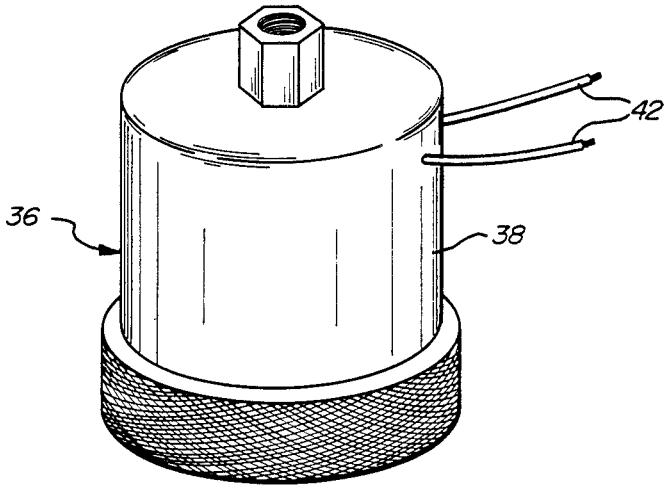
FIG. 4
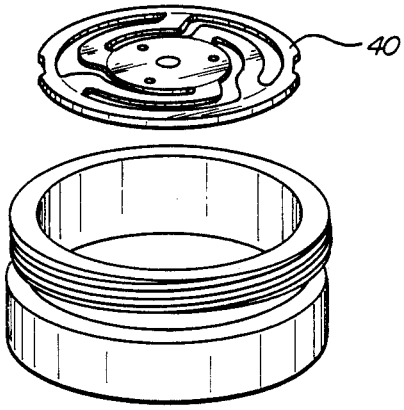

ELECTROSTATIC SPRAY COATING SYSTEM

TECHNICAL FIELD

The subject invention relates to spray coating apparatuses of the type for applying a flammable liquid coating material onto a work part, and more particularly to an electrostatic spray coating installation wherein the coating process is conducted inside of a spray booth for safety purposes.

BACKGROUND ART

Spray coating apparatuses which apply flammable liquid coating materials onto work parts are old and well known in the art. With the evolution of industrial safety standards, however, precautions must now be taken to prevent the accidental explosion or ignition of the flammable coating material sprayed during the coating operation. For this purpose, the work part is enclosed within a spray booth during the coating operation. Much care is taken to eliminate electrical components from the interior of the spray booth due to the possibility of an electric spark resulting from shorting wires, etc. inside the spray booth. It has been the practice, therefore, to actuate valves and the like with pneumatic signals instead of electrical signals due to the inability of pressurized air to create a spark.

Typically, in industrial spray coating operations, e.g., the mass quantity painting of motor vehicle bodies, a different color of paint may be required for each work part to be coated. A manifold-like color changer is provided to supply numerous colors of coating materials to the discharge atomizer. As described above, pneumatic valves, i.e., needle valves, are associated with the color changer for supplying a particular color of paint to the discharge atomizer at a predetermined time in response to a pneumatic signal. The pneumatic signal is sent from an automatic timing means, e.g., a computer controlled solenoid valve associated with a supply of compressed air, from outside the spray booth. The pneumatic signal, traveling through a feed hose extending into the spray booth to the pneumatic valve, actuates the valve to allow a particular color of paint to flow to the discharge atomizer.

The prior art spray coating apparatuses as described above are deficient in several respects. First, the prior art systems are inherently sluggish. That is, the response time between the sending of the pneumatic signal from outside the spray booth to the actuation of the pneumatic needle valve can be as much as several seconds. This is because a relatively large distance is traversed between the means for sending the pneumatic signal outside of the spray booth to the pneumatic valve inside of the spray booth. This requires that each spray coating apparatus be calibrated, at the automatic timing means, to compensate for the lag between the production of the pneumatic signal and the actuation of the associated pneumatic valve.

Secondly, because industrial spray coating apparatuses of the type herein described typically provide a selection of between twelve and thirty six alternative colors of paint, a great many pressurized air feed hoses must be provided between the means for sending the pneumatic signal and the pneumatic valves. Spray coating apparatuses of the type herein described are typically manufactured in one location and shipped to the purchaser for assembly by field installers. The field installers must carefully identify and then attach the proper feed hoses at one end to the automatic timing means and at the other end to the pneumatic valves at the color changer. It will be appreciate that this is not only a tedious and time consuming task, but also requires much testing after assembly to ensure the proper placement of the feed hoses.

Additionally, relatively larger diameter feed hoses must be provided between the automatic timing means and the pneumatic valves due to the relatively large distance which must be traversed by the pressurized air. In other words, because of the head loss phenomena, large diameter feed hoses are required to convey sufficient air pressure from the source to the pneumatic valve for actuation. It will be appreciated that a great many large diameter feed hoses extending a significant distance through a spray coating plant substantially increases the costs of the apparatus.

SUMMARY OF THE INVENTION AND ADVANTAGES

A spray coating apparatus of the type for applying a flammable liquid coating material onto a work part is provided. The apparatus comprises spray booth means for containing the sprayed flammable coating material in an isolated zone, discharge means disposed in the spray booth means for discharging the coating material onto the work part, a pneumatic valve disposed in the spray booth means for supplying the coating material to the discharge means at a predetermined time in response to a pneumatic signal, conduit means extending from an air supply outside the spray booth means to the pneumatic valve for supplying a flow of pressurized air to the pneumatic valve, and control means for controlling the pneumatic signal sent to the pneumatic valve. The subject invention is characterized by the control means including intrinsically safe electric valve means disposed in the spray booth means and preventing air flow through the conduit means for allowing the pressurized air to flow through the conduit means to the pneumatic valve in response to an electric signal to pneumatically signal to pneumatic valve.

The subject invention overcomes all of the deficiencies described above in the prior art systems by providing intrinsically safe electric valve means inside of the spray booth means. In this manner, the electric valve means is disposed closely, e.g., within several feet, to the pneumatic valves. Therefore, the response time between the sending of a pneumatic signal, at the electric valve means, and the actuation of the pneumatic valve is very short. In other words, the lag time between the sending of the pneumatic signal and the response of the pneumatic valve is negligible. Additionally, all of the feed hoses between the electric valve means and the pneumatic valve can be preinstalled at the place of manufacture, prior to shipping, so that field installers will not have an opportunity to improperly assemble the apparatus and will not be required to test once assembled. Furthermore, when multiple colors of coating material are made available, a multitude of feed hoses are not required to carry pressurized air from a source outside the spray booth to the pneumatic valves inside the spray booth. Instead, one main air hose can be provided from a source outside the spray booth, with the electric valve means then operated selectively disburse a pneumatic signal to the pneumatic valve once inside the spray booth.

Because the atmosphere inside the spray booth means is considered hazardous due to the flammable spray coating, the electric valve means is made intrinsically safe so that under even normal conditions it is made incapable of releasing sufficient electrical energy to cause ignition of the liquid coating material in its most easily ignited concentration.

BRIEF DESCRIPTION OF THE DRAWINGS

Other advantages of the present invention will be readily appreciated as the same becomes better understood by reference to the following detailed description when considered in connection with the accompanying drawings wherein:

FIG. 3 is a electrical diagram of the intrinsically safe electric valve means; and FIG. 4 is an exploded view of a solenoid valve according to the subject invention.

DETAILED DESCRIPTION OF THE PREFERRED EMBODIMENT

Figure 1:
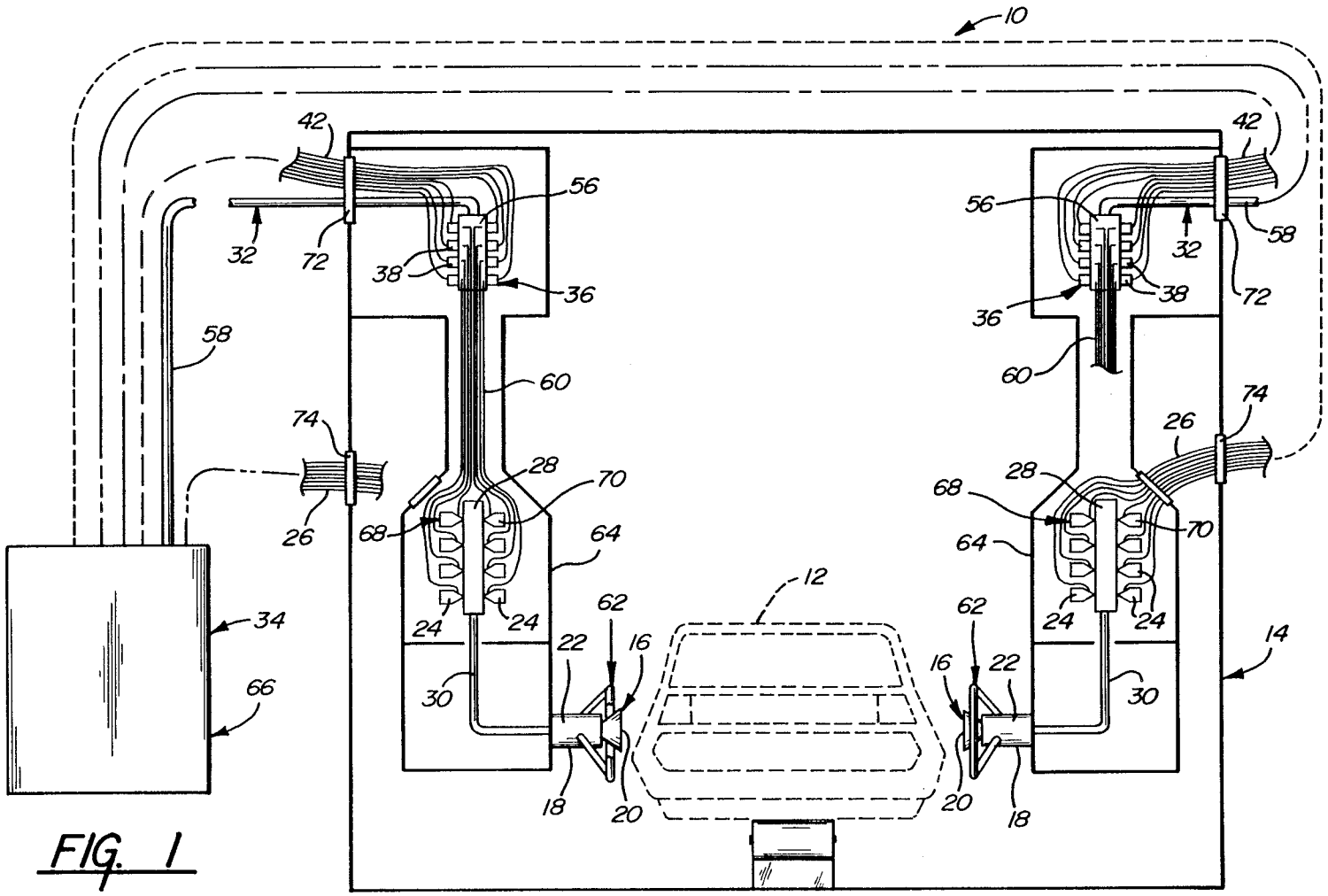
FIG. 1 is a simplified view of a spray coating apparatus according to the subject invention.

A spray coating apparatus according to the subject invention is generally shown at 10 in FIG. 1. The apparatus 10 is particularly adapted for applying a flammable liquid coating material onto a work part, and more particularly any one of several alternative colors of coating material onto successive automotive vehicle bodies. For reference, an automotive vehicle body is shown in phantom at 12 in FIG. 1. Although the preferred embodiment of the subject invention 10 is capable of applying thirty-six alternative colors, and conceivably even more, only six alternative colors are provided for simplicity in the embodiment shown in FIG. 1.

A spray booth means, generally indicated at 14 in FIG. 1, is provided for containing sprayed flammable coating material in an isolated zone. The spray booth 14 encloses the auto bodies 12 while they are painted to contain the oversprayed coating material. The atmosphere inside the spray booth 14 is considered hazardous due to the highly ignitable mixture of air and atomized paint particles. For this reason, the atmosphere inside the spray booth 14 is constantly circulated by using large fans. The emissions exhausted from the spray booth 14 are directed out a stack.

Figure 2:
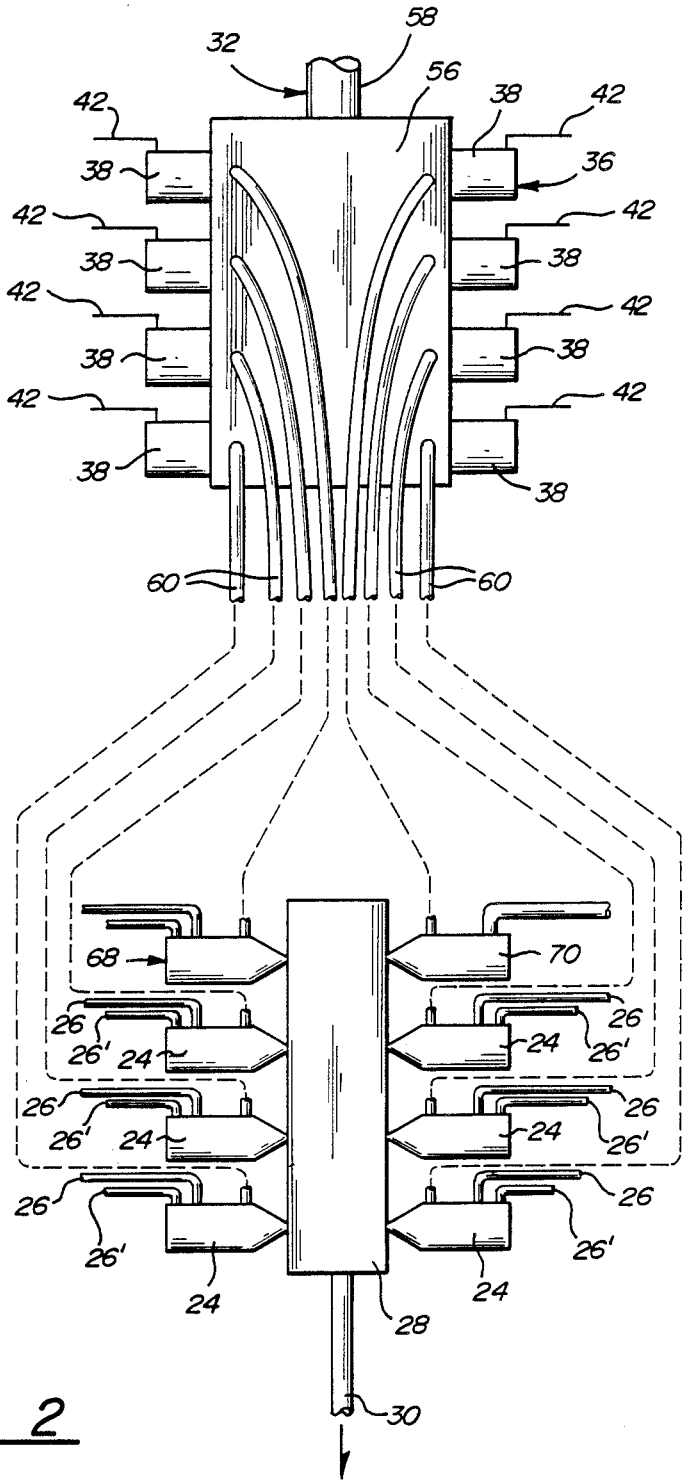
FIG. 2 is a simplified schematic of the air manifold and color changer according to the subject invention.

A discharge means, generally indicated at 16 in FIGS. 1 and 2, is disposed in the spray booth 14 for discharging the coating material onto the work part 12. The discharge means 16 includes a liquid atomizer 18. The atomizer 18 includes a bell 20 supported for rotation about a central axis thereof. A rotator means, preferably comprising an air turbine 22, rotates the bell 20 about its central axis at high speed. Paint is fed to the bell 20 as it rotates so that centrifugal force discharges and atomizes the paint in a radially outward direction.

A pneumatic valve 24 is disposed in the spray booth 14 for supplying the coating material to the discharge means 16 at a predetermined time in response to a pneumatic signal. That is, paint is associated with the pneumatic valve 24. When several alternative paint colors are available, as shown in FIGS. 1 and 2, a pneumatic valve 24 is associated with each paint color. A paint line 26, or conduit, is associated with each pneumatic valve 24 for conveying liquid paint from a source outside the spray booth 14 to each of the pneumatic valves 24.

The discharge means 16 also includes a color changer 28 having an inlet associated with the pneumatic valve 24 and an outlet disposed upstream of the atomizer 18 for directing coating material from the pneumatic valve 24 to the atomizer 18 via a flexible supply line 30. As numerous pneumatic valves 24 are, in the preferred embodiment, associated with the color changer 28, the color changer 28 functions as a manifold, or gate-like device for directing paint from one of the pneumatic valves 24 to the atomizer 18. Preferably, the pneumatic valves 28 include a linearly actuated needle, responsive to pressure differentials such as from the pneumatic signal, which allows paint to flow from one of the paint lines 26 to the atomizer 18 when actuated.

Conduit means, generally indicated at 32 in FIGS. 1 and 2 extend from an air supply outside the spray booth 14 to each of the pneumatic valves 24 for supplying a flow of pressurized air to the pneumatic valves 24. Control means, generally indicated at 34, control the pneumatic signal sent to the pneumatic valve 24. The control means 34 is associated with the conduit means 32 so that when the control means 34 determines that it is time for one of the pneumatic valves 24 to open, or close, the pneumatic signal is sent via the conduit means 32.

The subject invention is characterized by the control means 34 including intrinsically safe electric valve means, generally indicated 36 in FIGS. 1-4, which is disposed in the spray booth means 14 and prevents air flow through the conduit means 32 for allowing the pressurized air to flow through the conduit means 32 to the pneumatic valve 24 in response to an electric signal to pneumatically signal the pneumatic valve 24. That is, the electric valve means 36 is part of the control means 34 which controls when the pneumatic signal is sent to the pneumatic valves 24. The electric valve means 36 blocks, or prevents, air flow through the conduit means 32 until actuated by an electrical signal, also sent by a member of the control means 34, at which time the electric valve means 36 allows pressurized air to flow through the conduit means 32 to the pneumatic valve 24. Therefore, when the electric valve means 36 is electrically signaled, pressurized air is immediately allowed to flow through the conduit means 32, thus actuating the pneumatic valve 24 and allowing paint to flow from one of the paint lines 26 to the atomizer 18.

As shown in FIG. 4, the intrinsically safe electric valve means 36 includes a solenoid valve 38. Preferably, the solenoid valve 38 is of the type including a spider-plate armature 40 as manufactured under the trade name "Minimatics" by Clippard Instrument Laboratories, Inc. Solenoid valves of this type are preferred for disposition inside of the spray booth 14 because of the extremely low power required for operation. Specifically, the solenoid valve 38 draws 0.65 Watts of power from a 15.5 Volt DC power source. Such low power requirements are essential due to the hazardous and flammable nature of the atmosphere inside the spray booth 14.

The 15.5 Volt DC power source referred to above is disposed outside of the spray booth 14 and sends an electrical signal to the solenoid valve 38 via an electrical wire 42. As will be readily o appreciated, one solenoid valve 38 is associated with each pneumatic valve 24. Therefore, as many electrical wires 42 and solenoid valves 38 will extend between the power source and the electric valve means 36 as there are pneumatic valves 24.

The electric valve means 36 of the subject invention is made acceptable for use in hazardous atmospheric conditions inside the spray booth 14 by including a current limiting barrier, generally indicated at 44 in FIG. 3, disposed between the solenoid valve 38 and the power source for making the electric valve means 36 intrinsically safe.

Intrinsically safe equipment may be defined as such equipment incapable of releasing sufficient electrical or thermal energy, under normal or abnormal conditions, to cause ignition of a specific atmospheric mixture in its most easily ignited concentration. This is achieved in the subject invention by limiting the power available to the solenoid valve 28 in the hazardous area inside of the spray booth 14 to a level below that required to ignite the atomized paint.

The current limiting barrier 44 is disposed within the spray booth 14 and is preferably incorporated within the windings, or stator, of the solenoid valve 38 as will be described subsequently. However, for clarity, FIG. 3 is shown in an extremely simplified diagrammatic manner to illustrate the current limiting concept. The solenoid valve 38 is shown in FIG. 3 in a typical prior art form, as distinguished from the preferred spider-plate armature type of FIG. 4, wherein an armature 46 is shown as an axially movable shaft disposed within the helical winding of a stator 48. The current limiting barrier 44 is shown to include three parallel zener diodes 50, one resister 52 and one fuse 54. The current limiting barrier 44 is grounded at the neutral or the incoming power distribution to provide a return path for faults that would connect the incoming power to the safe area side of the current limiting barrier 44. For a more complete description of the current limiting barrier operation and application, reference may be had to the article "Intrinsic Safety, An Alternative of Explosion-Proof", by Greg Ernst, *Measurements and Control*, April 1987.

The current limiting barrier 44 protects against several conditions that could cause spark inside the spray booth 14 capable of igniting the flammable coating material therein. Such conditions include shorting of the electric wires 42 in the spray booth 14, breaking of the electrical wires 42 in the spray booth 14, grounding of the electrical wires 42 in the spray booth 14, or failure of the power supply in the safe area, outside the spray booth 14, allowing a supply voltage greater than is permissible to be applied to the current limiting barrier 44. Preferably, the electrical components of the current limiting barrier 44 are incorporated directly into the windings of the stator in the solenoid valve 38, so that one compact package is mounted for operation inside the spray booth 14.

As best shown in FIG. 2, each of the solenoid valves 38 is supported by a common manifold 56 having a pressurized air inlet and a pressurized air outlet, with the solenoid valve 38 disposed between the inlet and the outlet. As numerous solenoid valves 38 are contemplated with any one manifold 56, a corresponding number of air outlets are provided, with one solenoid valve 38 being associated with each air outlet. A main air hose 58 extends between the air supply outside of the spray booth 14 and the manifold 56 air inlet. The main air hose 58 has a first cross-sectional area which is generally constant along its entire length. A pressurized air feed hose 60 extends from each outlet of the manifold 56 to an associated pneumatic valve 24. The feed hoses 60 have a second cross-sectional area which is generally constant along the entire length. The first cross-sectional area of the main air inlet 58 is significantly larger than the second cross-sectional area of the feed hose 60 because the main air line 58 must convey pressurized air a substantially greater distance than any of the feed hoses 60.

When an electrical signal is sent via the electric wires 42 to one of the solenoid valves 38, the spider-plate armature 40 is actuated allowing the passage of air between the main air line 58 and one of the feed hoses 60. This allows pressurized air to travel to one of the pneumatic valves 24 thus actuating the pneumatic valve 24 and allowing the associated paint to flow to the atomizer 18.

As shown in FIG. 1, the discharge means 16 further includes electrostatic charging means, generally indicated at 62, for applying an electrostatic charge to the coating material sprayed. The electrostatic charging means 62 may take any one of several alternative forms such as means for electrostatically charging the paint particles by the corona discharge method, as suggested by the concentric charging ring in FIG. 1, or alternatively by the well known contact-charging method.

A protective cover 64 surrounds the manifold 56 and solenoid valves 38, along with the color changer 28 and the pneumatic valves 24. The protective cover 64 prevents oversprayed paint particles from depositing on the elements encased therein. Preferably, the atomizer 18 is disposed outside of the protective cover 64 while the supply line 30 and feed hoses 60 are enclosed within.

The atomizer 18 may be either securely fastened to the protective cover 64, or may be separately attached to a robot arm (not shown) independently controlled by a computer to move the atomizer 18 along a predetermined path during the spraying operation.

The control means 32 includes automatic timing means, generally indicated at 66, associated with the power source and disposed outside the spray booth 14 for controlling the times at which the electrical signal is sent to the solenoid valves 38. The automatic timing means 66 is a computer controlled apparatus which has been preprogrammed to turn on and shut off the paint flow to the atomizer 18 at predetermined times.

As best shown in FIG. 2, flushing means, generally indicated at 68, is associated with the discharge means 16 for flushing coating material from the discharge means 16. As is well known in the art, one of the pneumatic valves 24 associated with the color changer 28 supplies, instead of coating material, liquid solvent into the internal flow lines in the discharge means 16. A pneumatic valve 70, disposed opposite the flushing means 68, supplies compressed air, in lieu of paint, in the color changer 28.

To effectively flush coating material from the discharge means 16, liquid solvent and compressed air are introduced into the color changer 28 and through the internal flow passages leading to the atomizer 18 to clean and dry the system. The remaining six pneumatic valves 24 shown in FIG. 2 each supply a different color of paint to the atomizer 18. As shown, each pneumatic valve 24 includes two paint lines 26, 26'. The prime designation indicates a paint return line. When the pneumatic valve 24 is in its closed, i.e., unactuated, condition, the paint supplied via the paint line 26 must be kept continually moving to prevent degradation. Therefore, a return line 26' is provided so that the paint can be recirculated.

Preferably, a quickly connectable coupling 72 is provided at the wall of the spray booth 14 for allowing quick, easy and reliable assembly of the main air hose 58 and electrical wires 42. Likewise, a quickly connectable coupling 74 is provided at the wall of the spray booth 14 for the paint lines 26. The couplings 72, 74 allow field personnel to assemble the spray coating apparatus 10 without crossing wires or lines, etc.

The subject invention 10 overcomes many of the deficiencies of the prior art by providing intrinsically safe valve means 26 inside the spray booth 14. The solenoid valve 38 of the electric valve means 36 are made intrinsically safe by the current limiting barrier 44 so that accidental grounding, etc., of the electrical wires 42 will not cause a spark sufficient to ignite the hazardous atmospheric mixture inside the spray booth 14. By providing solenoid valves 38 inside the spray booth 14, the distance between themselves and the pneumatic valves 24 is considerably reduced so that response time between the production of the pneumatic signal at the solenoid valve 38 and the response at the pneumatic valves 24 is significantly reduced. Therefore, excessive lag time does not need to be accounted for by the automatic timing means 66. Furthermore, a plurality of air line hoses need not be assembled on the field, but may be factory installed to diminish assembly time on site.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A spray coating apparatus (10) for applying a flammable liquid coating material onto a work part (12), said apparatus (10) comprising: spray booth means (14) for containing the sprayed flammable coating material in an isolated zone; discharge means (16) disposed in said spray booth means (14) for discharging the coating material onto the work part (12); a pneumatic valve (24) disposed in said spray booth means (14) for controlling supply of the coating material to said discharge means (16) in response to a pneumatic signal; conduit means (32) extending from an air supply outside said spray booth means (14) to said pneumatic valve (24) for supplying said pneumatic signal to said pneumatic valve (24); control means (34) for controlling the pneumatic signal sent to said pneumatic valve (24); and said control means (34) including intrinsically safe electric valve means (36) in fluid communication with said conduit means (32) and disposed in said spray booth means (14) remote and electrically isolated from said pneumatic valve (24) for alternately preventing and allowing the pneumatic signal to flow through said conduit means (32) to said pneumatic valve (24) solely in response to an electrical signal to said electric valve means (36) to pneumatically signal said pneumatic valve (24).

2. An apparatus (10) as set forth in claim 1 in which said intrinsically safe electric valve means (36) includes a solenoid valve (38).

3. An apparatus (10) as set forth in claim 2 in which said control means (34) includes an electrical power source disposed outside said spray booth means (14) for sending an electrical signal to said solenoid valve (38).

4. An apparatus (10) as set forth in claim 3 in which said intrinsically safe electric valve means (36) includes a current limiting barrier (44) disposed between said solenoid valve (38) and said power source.

5. An apparatus (10) as set forth in claim 4 in which said current limiting barrier (44) is disposed in said spray booth means (14).

6. An apparatus (10) as set forth in claim 5 in which said solenoid valve (38) includes a spider plate armature (40).

7. An apparatus (10) as set forth in claim 6 wherein said solenoid valve (38) is supported by a manifold (56) having a pressurized air inlet and a pressurized air outlet with said solenoid valve (38) disposed between said inlet and said outlet, in which said conduit means (32) includes a main air hose (58) extending between the air supply and said manifold (56) inlet and having a first cross-sectional area, and a feed hose (60) extending between said manifold (56) outlet and said pneumatic valve (24) and having a second cross-sectional area smaller than said first cross-sectional area.

8. An apparatus (10) as set forth in claim 7 in which said discharge means (16) includes a liquid atomizer (18).

9. An apparatus (10) as set forth in claim 8 in which said atomizer (18) includes a bell (20) supported for rotation about a central axis thereof.

10. An apparatus (10) as set forth in claim 9 in which said discharge means (16) includes rotator means (22) for rotating said bell (20) about said central axis.

11. An apparatus (10) as set forth in claim 8 in which said rotator means (22) includes an air turbine (22).

12. An apparatus (10) as set forth in claim 11 in which said discharge means (16) includes a color changer (28) having an inlet in fluid communication with said pneumatic valve (24) and an outlet disposed upstream of said atomizer (18) for directing coating material from said pneumatic valve (24) to said atomizer (18).

13. An apparatus (10) as set forth in claim 12 in which said discharge means (16) includes a flexible supply line (30) for conveying coating material from said outlet of said color changer (28) to said atomizer (18).

14. An apparatus (10) as set forth in claim 13 in which said discharge means (16) includes electrostatic charging means (62) for applying an electrostatic charge to the coating material sprayed.

15. An apparatus (10) as set forth in claim 14 further comprising a protective cover (64) surrounding said manifold (56) and said solenoid valve (38), and said color changer (28) and said pneumatic valve (24).

16. An apparatus (10) as set forth in claim 15 in which said control means (34) includes automatic timing means (66) operatively coupled with said power source for controlling the times at which the electrical signal is sent to said solenoid valve (38).

17. An apparatus (10) as set forth in claim 16 further comprising flushing means (68) operatively coupled with said discharge means (16) for flushing coating material from said discharge means (16).

* * * * *